United States Patent [19]

Jawad

[11] 4,296,869

[45] Oct. 27, 1981

[54] PRESSURE VESSEL HEAD

[75] Inventor: Maan Jawad, Collinsville, Ill.

[73] Assignee: Nooter Corporation, St. Louis, Mo.

[21] Appl. No.: 40,597

[22] Filed: May 18, 1979

[51] Int. Cl.[3] ..... E04B 1/32

[52] U.S. Cl. ..... 220/3; 52/80; 52/81

[58] Field of Search ..... 220/3, 66, 67, 75, 76, 220/83, 84; 52/80, 81, 395

[56] References Cited

U.S. PATENT DOCUMENTS

| | | | |
|---|---|---|---|
| 2,365,697 | 12/1944 | Grubb | 220/3 |
| 3,052,021 | 9/1962 | Needham | 220/3 X |
| 3,231,338 | 1/1966 | Andrus | 220/3 X |
| 3,857,212 | 12/1974 | Barnett | 52/81 |
| 3,924,367 | 12/1975 | Stewart | 52/80 |

*Primary Examiner*—Steven M. Pollard
*Attorney, Agent, or Firm*—Gravely, Lieder & Woodruff

[57] ABSTRACT

A layered head for a pressure vessel includes a frame which has the general contour of the head and is formed from a plurality of stiffeners, some of which extend circumferentially and others of which extend meridionally. The stiffeners create a grid and each opening of the grid is occupied by a plurality of plates which are curved to match the contour of the frame and are stacked upon one another in face-to-face contact. Moreover, the several plates in each grid opening are progressively larger in surface area, with the innermost plate having the smallest surface area and the outermost plate having the largest. The peripheral edges of the plates are located directly opposite the sides of the stiffeners, and to accommodate the variance in the surface areas of the plates, the sides of the stiffeners are stepped. The individual plates are welded along their peripheral edges to the stiffeners, and because of the stepped configuration of the stiffeners and the variances in the surface areas of the plates, the welds of successive plates are offset from each other.

10 Claims, 5 Drawing Figures

FIG. 1
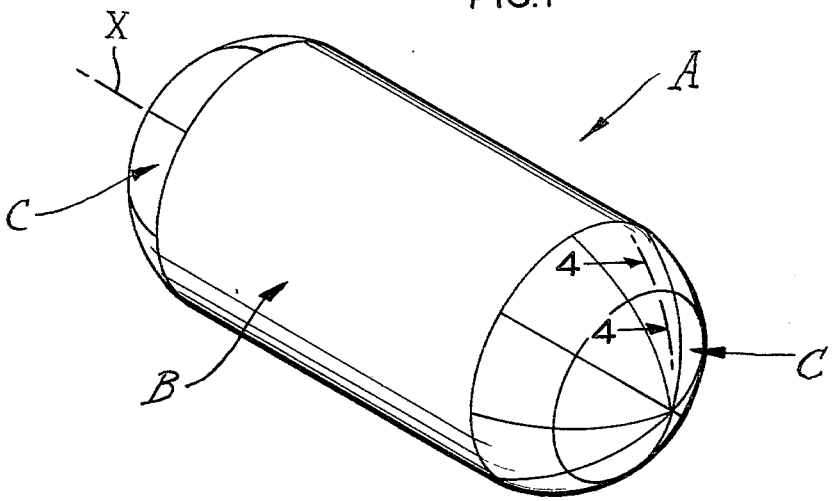
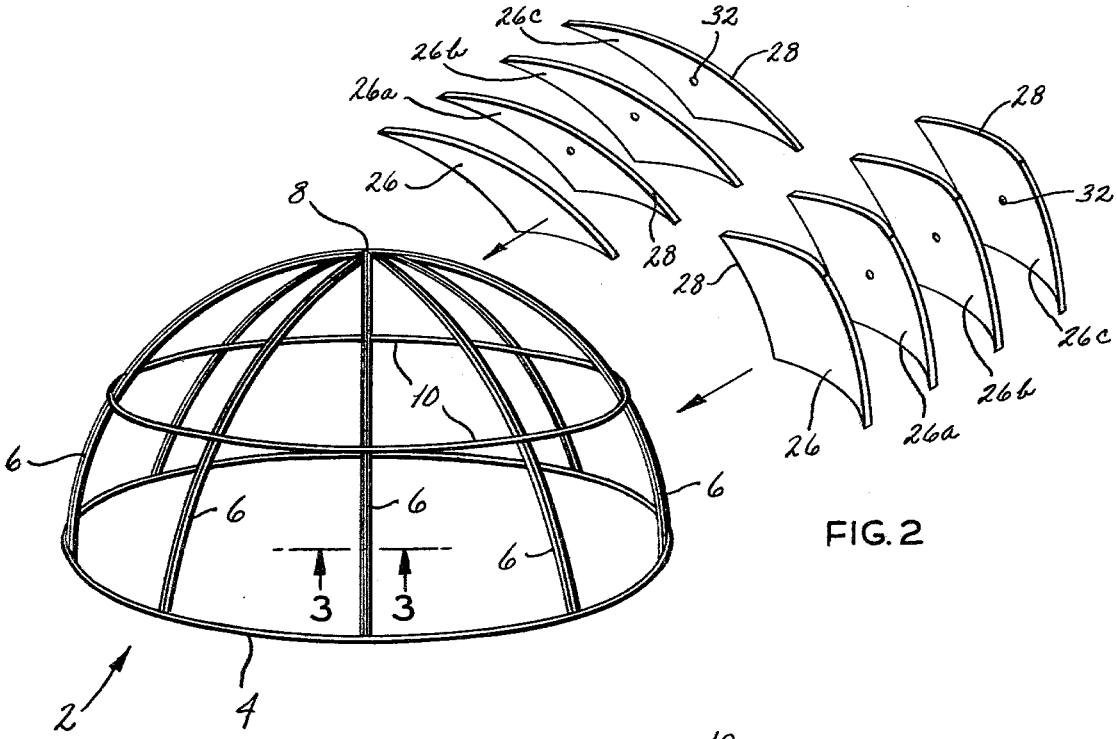
FIG. 2
FIG. 3
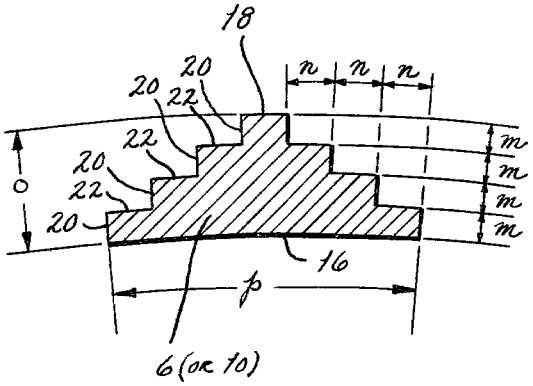

PRESSURE VESSEL HEAD

BACKGROUND OF THE INVENTION

This invention relates in general to pressure vessels and more particularly to a layered head for a pressure vessel and to a method of producing such a head.

The typical pressure vessel has a cylindrical shell and heads that close the two ends of the shell. The shell and heads are manufactured as separate components and are thereafter joined together by welding to produce a unitary structure. The heads are somewhat dome-shaped to enable them to better withstand elevated pressures.

It is generally recognized that vessel walls composed of multiple layers are superior to thick single walls in many respects. For example, the individual plates of a layered wall, generally speaking, have better metallurgical properties than thick solid walls, since they are subjected to greater rolling at the mill. As a consequence, a layered vessel is usually safer than a solid wall vessel of equivalent wall thickness. Whereas thick solid walls exhibit a tendency to laminate, layered walls rarely display this tendency because of their better metallurgical properties. Also, in layered vessels it is possible to vary the metal alloy from layer to layer, thus enabling an expensive corrosion resistant liner to be used with less expensive surrounding layers. While thick steel plates clad with various corrosion resistant alloys are available from steel mills, they are more expensive. Moreover, thin layers are relatively easier to shape than the heavy steel plate used in solid wall vessels. Thus, layered walls can be manufactured in greater thickness than solid walls. Aside from that, the individual layers that comprise the wall of a layered vessel, upon being welded together, tend to shrink as the welds which join them solidify and cool, and this places the inner layers in a state of precompression. This is desirable since the elevated pressures within the vessel create tensile forces in the vessel walls. In contrast, solid wall vessels are normally heat treated to relieve them of the stress concentrations resulting primarily from the welds that are made during fabrication.

Heretofore different procedures have been developed for fabricating cylindrical shells from multiple layers, one highly successful procedure being set forth in U.S. Pat. No. 4,478,784. Heads, by reason of their compound curvatures are not easily fabricated in multiple layers, and as a consequence most heads are still of the solid wall construction. Thus, to a large measure, the limitations of present pressure vessels are set by the heads at their ends.

SUMMARY OF THE INVENTION

The present invention is embodied in a layered head for a pressure vessel with the head being comprised of a frame and curved plates arranged in layers on the frame. Another object is to provide a head of the type stated which is relatively easy and simple to construct. A further object is to provide a head of the type stated which may without difficulty be fabricated in large sizes. An additional object is to provide a head in which the inner layers of head are initially in a state of precompression. Still another object is to provide a head in which the welds for the overlying layers are offset from each other. Yet another object is to provide a process for producing a head of the type stated. These and other objects and advantages will become apparent hereinafter.

The present invention is embodied in a pressure vessel head including a frame formed from a plurality of stiffeners arranged in a grid and overlying plates occupying the openings in the grid. The plates are welded to the stiffeners along their peripheral edges. The invention also resides in the combination of the head and a shell and the process for producing the head. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur FIG. 1 is a perspective view of a pressure vessel provided with heads constructed in accordance with and embodying the present invention;

FIG. 2 is a perspective view of the frame for a head and a series of plates that fit into grid openings of the frame;

FIG. 3 is a sectional view taken along line 3—3 of FIG. 2 and showing one of the frame stiffeners in cross section;

DETAILED DESCRIPTION

Figure 4:
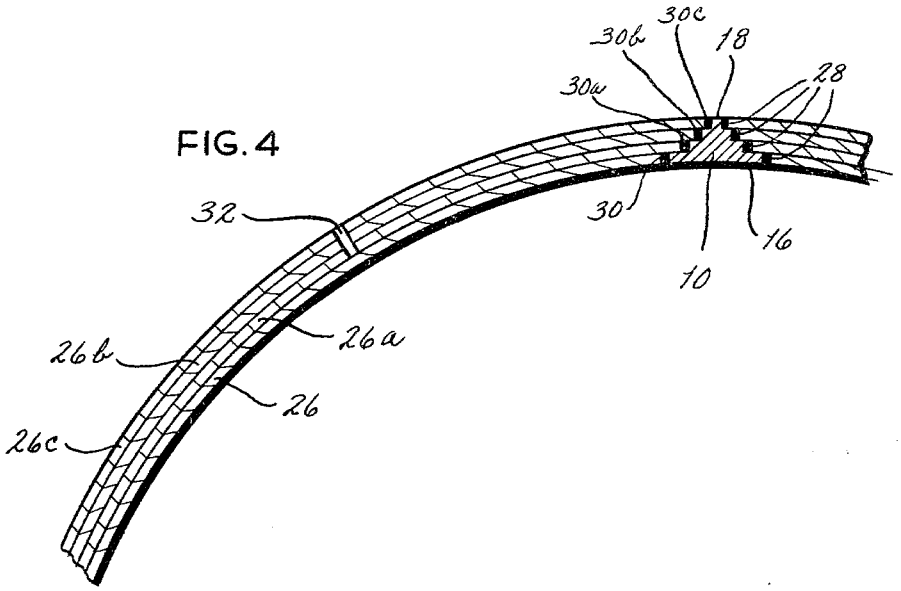
FIG. 4 is a fragmentary sectional view taken along line 4—4 of FIG. 1.

Referring now to the drawings (FIG. 1), A designates a pressure vessel including a shell B and heads C which extend across and close the ends of the shell B. The shell B is cylindrical in configuration and may be a single wall structure or a layered structure. A separate head C is welded to each end of the shell B, and each head C curves outwardly away from the end of the shell B so that the end of the pressure vessel A is convex or dome-shaped. While the specific curvature of the head C may be critical from the standpoint of a particular application, it is not critical insofar as the general principles of construction are concerned. Those principles apply to hemispherical heads as well as heads of other contour such as ellipsoidal heads. They likewise apply to curved heads, irrespective of whether they have auxiliary shapes and appendages, such as inspection ports, flues, and extensions. Also, it should be recognized that a suitable pressure vessel may be produced without the shell B, that is with the heads C joined directly together.

In its simplest form, each head C includes a frame 2 (FIG. 2) formed from a circumferential base stiffener 4 and a plurality of meridional stiffeners 6 which curve away from the circumferential stiffener 4 and meet at an apex 8 along the centerline or axis X of the head C. The circumferential base stiffener 4 is circular and corresponds in diameter to the diameter of the shell B. The curvature of the meridional stiffeners 6 depends on the type of head that is desired. Also, the frame 2 preferably has at least one circumferential intermediate stiffener 10 which connects the meridional stiffeners 6 intermediate the base stiffener 4 and the apex 8 and is truly circular in configuration so as to completely encircle the frame 2. The stiffeners 4, 6 and 10 are all joined together by welding such that the inwardly presented surfaces of any two intersecting stiffeners 4, 6, 10 are flush at the welded joint, and the same holds true as to the outwardly presented surfaces.

Each stiffener 4, 6, 10 is formed from a bar of high strength metal such as steel. The bar is machined or otherwise shaped to provide the stiffener 4, 6, or 10 with a stepped cross-sectional configuration. Then it is deformed into a curvature suitable for the particular stiffener 4, 6, or 10. More specifically, each stiffener 4, 6, 10 has a relatively wide inwardly presented surface 16 (FIG. 3), a relatively narrow outwardly presented surface 18, and a series of alternate shoulders 20 and lands 22 between the two surfaces 16 and 18. The shoulders 20 face laterally insofar as the stiffener 4, 6, or 10 is concerned, whereas the lands 22 face outwardly. Each shoulder 20 has a height m, while each land 22 has a width n. The total height o of the stiffener 4, 6, or 10 equals the sum of the heights m for the various shoulders 20. The width P of the inwardly presented surface 16 equals the sum of the widths n of the several lands 22 plus the width of the outwardly presented surface 18. In the case of the circumferential base stiffener 4, the shoulders 20 and lands 22 are only along one side of it. However, each meridional and intermediate stiffener 6 and 10 has shoulders 20 and lands 22 along both of its sides. Any stiffener 4, 6, 10 that is used in the head C of a vessel A that is to contain a corrosive substance, should be machined from a bar, the metal of which is resistant to attack by the substance, since the inwardly presented surfaces 16 of the stiffeners 4, 6, 10 are exposed to the interior of the vessel A. In the alternative, the stiffeners 4, 6, 10 may be a clad along their inwardly presented surfaces 16 with a metal that withstands attack by the corrosive substance. Likewise special metals or claddings are required where the contents of the vessel A produces other deleterious effects such as hydrogen embrittlement.

The frame 2, being in the shape of a grid, has openings of both somewhat trapezoidal and somewhat triangular configuration. These openings are occupied by trapezoidal and triangular plates 26, 26*a*, 26*b*, and 26*c* (FIGS. 2 and 4) which are dished or curved outwardly to match the contour of the frame 2 itself. In other words, the plates 26, 26*a*, 26*b*, and 26*c* are outwardly convex, meaning their outwardly presented surfaces are convex in configuration. The plates 26, 26*a*, 26*b*, 26*c* have their side edges 28 located directly opposite the shoulders 20 on the stiffeners 4, 6, 10 and are arranged in layers which correspond in thickness to the shoulders 20.

More specifically, the innermost plates 26 are installed first, and each has its side edges 28 located opposite to the innermost shoulders 20 on the several stiffeners 4, 6, 10 that surround it (FIG. 4). Indeed, the thickness of the plate 26 should equal the thickness of the innermost shoulder 20. The plate 26 should further be dished outwardly so that its curvature corresponds with that of the particular location on the frame 2 at which it is located. Since the plate 26 is attached to the surrounding stiffeners 4, 6, 10 by welding, its surface area should be slightly smaller than the grid opening into which the plate 26 fits. This provides a narrow space or groove between the side edges 28 of the plate 26 and the adjacent shoulders 20 on the surrounding stiffeners 4, 6, 10, and that space of course is capable of accommodating a weld for securing the plate 26 to the stiffeners 4, 6, 10. Since the plate 26 is relatively thin, it is not necessary to bevel its side edges to accommodate a weld.

The curved plate 26 is easily fabricated from a flat steel plate by a simple dishing procedure. This procedure is old and need not be considered in detail.

To install the plate 26 in the frame 2, the plate 26 is first manually held in the position that it is to assume within the frame 2, that is, with its inwardly presented surface flush with the inwardly presented surfaces 16 of the stiffeners 4, 6, 10 that surround it. Its outwardly presented surface will then be flush with the first or innermost lands 22 on those stiffeners 4, 6, 10. Its side edges 28, on the other hand, will be located opposite the innermost shoulders 20 on the stiffeners 4, 6, 10, although a slight space or groove will exist between the two. With the plate 28 in that position, several tack welds are made in the groove to temporarily secure the plate 26 to the frame 2. Then a complete butt weld 30 (FIG. 4) is made in the groove along the entire side edge 28 of the plate 26. After this weld cools, it is ground off flush with the first lands 22 on the surrounding stiffeners 4, 6, 10 and with the outwardly presented surface of plate 26.

The remaining plates 26 of the innermost layer are attached to the frame 2 in a similar manner.

As in the case of the stiffeners 4, 6, 10, if the vessel A is to contain a corrosive substance, then the plates 26 of the innermost layer should be formed from an alloy which resists attack by the corrosive substance. Of course that alloy should be compatible with the alloy of the stiffeners 46, 6, 10 in the sense that the two alloys can be welded together. In the alternative, the plates 26 of the innermost layer may be clad with a corrosion resistant alloy.

Once the plates 26 of the innermost layer have been welded to the frame 2 and the welds 20 have been ground flush, the plates 26*a* (FIGS. 2 and 4) of the second layer are attached to the frame 2 in a similar manner. These plates overlie the plates 26 of the first layer, yet are in face-to-face contact with the plates 26 of the first layer. They further overlie the welds 30 and the first lands 22 of the stiffeners 4, 6, 10. Consequently, the plates 26*a* of the second layer have slightly less curvature than the corresponding plates 26 of the first layer and slightly larger surface area as well. The thickness of each plate 26*a* for the second layer equals the height m of the second shoulders 20 on the stiffeners 4, 6, 10, so that the second lands 22 of the stiffeners 4, 6 and 10 and the outwardly presented surfaces of the plates 26*a* are flush. The primary consideration for the selection of the metal from which the plates 26*a* of the second layer are produced is its ability to withstand the stresses produced by elevated pressures within the vessel A. Of course, the metal should also be compatible with the metal of the stiffeners 4, 6, 10 in the sense that the two metals can be welded together. The plates 26*a* are formed in the same manner as the plates 26, only different contour templates and patterns are utilized.

After a plate 26*a* is cut to the proper size and deformed to the proper contour, it is laid into the frame 2 directly over the corresponding plate 26 of the first layer (FIG. 2). Its peripheral edge is spaced slightly inwardly from the second shoulder 20 on the surrounding stiffeners 4, 6, and 10 to form an outwardly opening groove in which another butt weld 30*a* (FIG. 4) is made. As the weld 30*a* solidifies and cools still further, it contracts, and this contraction draws the plate 26*a* of the second layer down tightly onto the underlying plate 26 of the first layer. In effect, the plates 26 of the first layer and the stiffeners 4, 6, 10 as well are placed in a state of precompression which enables them to better withstand the forces exerted on them by the highly pressurized contents in the vessel A.

After the plates 26a of the second layer are welded in place and the welds 30a ground flush, more plates 26b (FIGS. 2 and 4) are placed over the plates 26a of the second layer and they are also welded in place. Successive layers are built up in this manner until all of the lands 22 on the stiffeners 4, 6 and 10 are covered. The outermost layer of plates 26c overlies the outermost lands 22 on the stiffeners 4, 6, 10, and its outwardly presented surface lies flush with the outwardly presented surfaces 18 on the stiffeners 4, 6, 10. Moreover, the welds of each succeeding layer tend to draw the plates of that layer down tightly onto the plates of the underlying layer and increase the precompression of the underlying layers. Thus, by the time the outermost layer is in place, the plates 26 of the innermost layer are in substantial compression. No need exists for heat treatments, and indeed such treatments would relieve the precompression.

Once the head C is completed, it is welded to the end of the shell B along the circumferential base stiffener 4.

The plate 26 of the innermost layer as well as the stiffeners 4, 6, 10 and welds 30 which hold the plates 26 to the stiffeners 4, 6, 10 are completely impervious, and this of course enables the vessel A to hold elevated pressures. However, the plates 26a, 26b, 26c of the other layers are provided with weep holes 32 (FIGS. 2 and 4) which need not be aligned. The weep holes 32 permit entrapped air to escape during fabrication of the head C, and this insures that each plate 26a, 26b, 26c fits snugly over the plate immediately beneath it. Moreover, should one of the plates 26 or welds 30 of the innermost layer develop a leak, the vessel contents that escape from that leak will pass through the succession of weep holes 32 in the overlying plates 26a, 26b, 26c and will in short duration appear at the weep hole 32 in that plate 26c of the outermost layer which lies directly over the leak. Thus, the weep-holes 32 permit a source of pending failure to be detected well in advance—long before a major rupture occurs.

Figure 5:
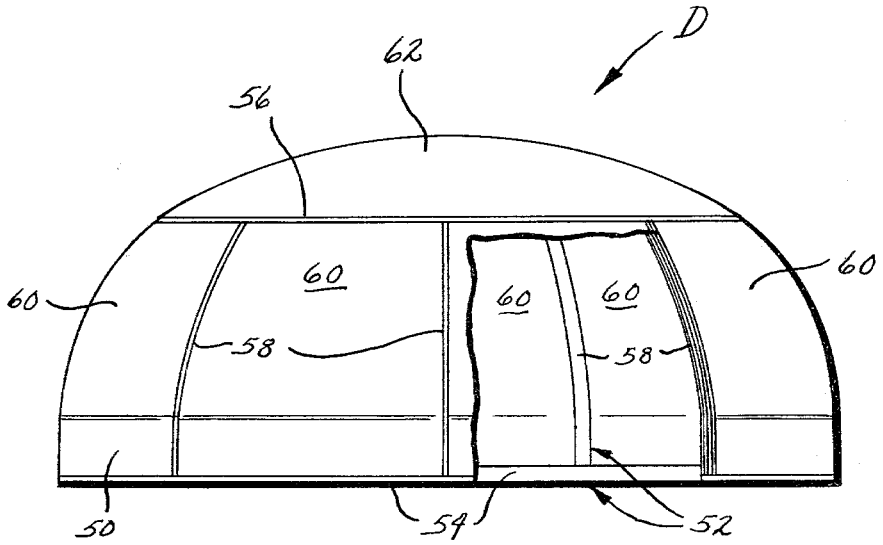
FIG. 5 is an elevational view, partially broken away and in section, of a modified head.

Heads may be formed in shapes other than hermispherical and with different frame configurations. For example, a modified head D (FIG. 5), which is also suitable for closing the end of the shell B, has an ellipsoidal configuration, that is in cross section it resembles one-half of an ellipse, and at its base it is provided with an extension 50 which facilitates attachment to the shell B. In effect, the extension 50, once the head D is welded to the shell B, serves as a short axial projection of the shell B, thereby making welding easier.

The head D includes a frame 52 which has base and end circumferential stiffeners 54 and 56, and meridional stiffeners 58 as well, but the meridional stiffeners 58 do not extend all the way to an apex. Instead, they terminate at the end circumferential stiffener 56. The stiffeners 54, 56 and 58 have the same stepped configuration as their counterparts in the frame 2 of the head C.

The generally trapezoidal spaces formed by the base, end, and meridional stiffeners 54, 56 and 58 are occupied by side plates 60 with each space containing a plurality of side plates 60 which are curved to match the contour of the side of the frame 52 and are attached to the frame 52 in the same manner as the corresponding plates 26 of the head C.

The circular space that is surrounded by the end circumferential stiffener 56 is occupied by a series of dished cap plates 62 which likewise are stacked upon each other and are welded to the circumferential stiffener 56 in the manner previously disclosed. The circular cap plates 62 may be fitted with an entry port that is closed by a removable cover or they may be provided with some other end configuration such as a flue.

While perhaps the stepped configuration is best suited for the stiffeners, other cross-sectional configurations are possible. For example, the stiffeners may be triangular in cross section.

The heads C and D are relatively easy to fabricate and provide all the advantages of layered construction. No limits exist on the thickness of the walls, as is true of solid wall constructions, for the thickness is merely dependent on the number of plates which are placed over one another in the grid openings of the frames 2 or 52.

This invention is intended to cover all changes and modifications of the example of the invention herein chosen for purposes of the disclosure which do not constitute departures from the spirit and scope of the invention.

What is claimed is:

1. A head for a pressure vessel, said head comprising: a frame having stiffeners arranged to form a grid, with each stiffener having a series of alternate lands and shoulders; plates closing the openings in the grid, there being a plurality of plates in each opening of the grid with the plates of each opening becoming progressively larger in surface area through the opening, the plates in each grid opening being stacked one upon the other such that the adjacent plates of each opening are directly against each other, the plates of each grid opening further being configured and positioned such that the shoulders for the stiffeners that are along the opening face the side edges of the stacked plates and the lands of the stiffeners underlie the peripheral portions of the plates; and welds along the peripheries of the plates and adjacent surfaces of the stiffeners for attaching the plates to the stiffeners, the welds for successive plates being offset from each other by reason of the variances in the size of the plates.

2. A head according to claim 1 wherein the height of each shoulder is substantially equal to the thickness of the plate located adjacent to it and the surfaces of that plate are generally flush with the lands that lead up to the shoulder.

3. A head according to claim 1 wherein the stiffeners that comprise the frame include a base stiffener that extends circumferentially around the frame and a plurality of meridional stiffeners that are attached to and extend away from the base stiffener such that they converge toward the center of the head.

4. A head according to claim 3 wherein the stiffeners that comprise the frame further include another circumferential stiffener that extends circumferentially around the frame and is spaced from the base stiffener, the other circumferential stiffener being connected with the meridional stiffeners.

5. A head according to claim 4 wherein the meridional stiffeners meet and are joined together at an apex at the center of the head.

6. A head according to claim 1 wherein all but the innermost plates in each opening of the grid have weep holes.

7. A process for fabricating a head for a pressure vessel, said process comprising: constructing a frame from stiffeners, with the frame forming a grid having the general contour desired for the head, the stiffeners being stepped in cross-sectional configuration such that they have alternate shoulders and lands; thereafter installing a plurality of outwardly convex plates in at least some of the openings of the grid, with the plates in each opening overlying each other and being in face-to-face contact, the plates in each opening further along their peripheries overlying the lands of the stiffeners and having their peripheral edges located directly opposite the shoulders of the stiffeners, all such that successive plates in any grid opening are of progressively greater area to accommodate the stepped configuration of the stiffeners; and welding the individual plates to the stiffeners along the peripheral edges of the plates, the welds for successive plates being offset from each other due to the stepped configuration of the stiffeners.

8. The process according to claim 7 wherein the stiffeners include a circumferential base stiffener at one end of the frame and a plurality of meridional stiffeners extended outwardly from the base stiffener and converging generally toward the center axis of the head.

9. In combination with a pressure vessel component such as cylindrical shell, a head comprising: a circumferential base stiffener attached to the end of the pressure vessel component; a plurality of meridional stiffeners attached to and extended outwardly from the base stiffener and converging toward the center of the head, the stiffeners being generally tapered in cross-section, with their inwardly presented surfaces being wider than their outwardly presented surfaces, the stiffeners further being stepped in cross-section so as to have alternate shoulders and lands; a plurality of curved plates located between each pair of adjacent meridional stiffeners, with the plates overlying each other and adjacent plates being directly against each other, the plates between each pair of adjacent meridional stiffeners being progressively larger in surface area, with the plate of smallest surface area being presented inwardly and the plate of largest surface area being presented outwardly, all to accommodate the taper of the stiffeners, the plates between each pair of adjacent meridional stiffeners being positioned and configured such that the shoulders of the pair of stiffeners are located opposite to the side edges of the plates and the lands of the pair of stiffeners underlie the peripheral portions of the plates; and welds extended along the peripheral edges of the plates and along the base and meridional stiffeners to join the plates to those stiffeners, the welds for successive plates being offset by reason of the variance in the surface areas of the plates between pairs of meridional stiffeners.

10. The process according to claim 7 wherein corresponding plates of each grid opening are installed to complete a layer on the frame before additional plates are installed in any grid opening to commence another layer on the frame.

* * * * *